United States Patent [19]

Tam

[11] 4,347,476

[45] Aug. 31, 1982

[54] VOLTAGE-TEMPERATURE INSENSITIVE ON-CHIP REFERENCE VOLTAGE SOURCE COMPATIBLE WITH VLSI MANUFACTURING TECHNIQUES

[75] Inventor: Matthias L. Tam, Monterey Park, Calif.

[73] Assignee: Rockwell International Corporation, El Segundo, Calif.

[21] Appl. No.: 212,783

[22] Filed: Dec. 4, 1980

[51] Int. Cl.[3] ..... G05F 3/20

[52] U.S. Cl. ..... 323/313; 323/907; 307/297; 307/304

[58] Field of Search ..... 323/313, 314, 907; 307/296 R, 297, 304, 310

[56] References Cited

U.S. PATENT DOCUMENTS

| | | | |
|---|---|---|---|
| 3,757,200 | 9/1973 | Cohen | 323/226 |
| 3,806,742 | 4/1974 | Powell | 323/313 X |
| 3,832,644 | 8/1974 | Nagata et al. | 323/313 X |
| 3,975,649 | 8/1976 | Kawagoe et al. | 323/907 X |
| 4,011,471 | 3/1977 | Rockett, Jr. | 323/313 X |
| 4,096,430 | 6/1978 | Waldron | 307/304 X |
| 4,100,437 | 7/1978 | Hoff, Jr. | 323/314 X |

FOREIGN PATENT DOCUMENTS

| | | | |
|---|---|---|---|
| 54-119653 | 9/1979 | Japan | 323/313 |

*Primary Examiner*—William M. Shoop
*Assistant Examiner*—Peter S. Wong
*Attorney, Agent, or Firm*—H. Fredrick Hamann; Wilfred G. Caldwell

[57] ABSTRACT

A voltage and temperature insensitive reference circuit voltage source for predetermining the proportion of supply voltage to constitute the output voltage including a pull-up device and a pull-down device connected between a source of supply voltage and a reference point. A two element biasing circuit is connected between the source and the pull-down device which is connected to the reference point with the pull-up device comprising a FET having a gate. A connection extends from the biasing circuit at a point between its elements to the gate. An output connection extends from the junction of the pull-up and pull-down device. One of the elements which is connected between the source and the other of the elements is characterized by high resistance relative to the other of the elements whereby the proportion of voltage available at the output connection remains substantially constant regardless of source voltage variation and ambient temperature.

2 Claims, 2 Drawing Figures

VOLTAGE-TEMPERATURE INSENSITIVE ON-CHIP REFERENCE VOLTAGE SOURCE COMPATIBLE WITH VLSI MANUFACTURING TECHNIQUES

FIELD OF THE INVENTION

The invention relates to a voltage reference source, and more particularly to such a source which can be manufactured by standard integrated circuit processing steps and is insensitive to voltage supply and temperature variations.

BACKGROUND OF THE INVENTION

While many circuits exist that are useful as voltage reference sources, all such known circuits have a large number of components to effect super accuracy. Typical of one such circuit is the one disclosed in "A New NMOS Temperature Stable Voltage Reference" by Blauschild et al published in the IEEE Journal of Solid State, Vol. SC13, No. 6, December 1978, beginning at page 677. However, such a circuit includes sixteen FETs to achieve its purposes. On the other hand, the subject circuit includes only four FETs, is temperature and voltage insensitive, and is circuit tolerant to process variations in regard to oxide thickness, substrate resistivity and other yield affecting factors. It is also compatible with manufacturing techniques for implementation in MOS porcesses including P and N-channel, metal gate and silicon gates using single or double polysilicon layers or other techniques.

SUMMARY OF THE INVENTION

The invention comprises a voltage divider circuit comprising two FETs connected between a source of supply voltage and a reference point with an output voltage lead extending from between the FETs. A biasing circuit is connected between the source and that one of the FETs connected to the reference point, and connection means extend from the biasing circuit to the other FET of the voltage divider circuit to influence the conduction of both said FETs to maintain said output voltage substantially constant by selecting more or less of the supply voltage. One of the biasing circuit elements is an enhancement FET and the other has a high resistance relative to said FET and can be realized with a depletion FET or a resistor element.

DESCRIPTION OF THE PREFERRED EMBODIMENT

Figure 1:
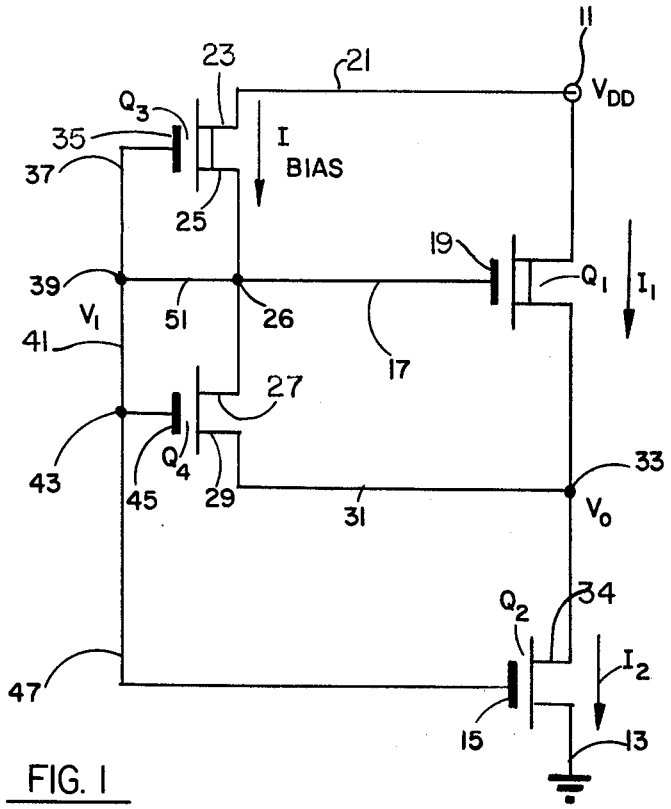
FIG. 1 is a circuit diagram of the preferred circuit.

In FIG. 1 there is shown a four FET (field effect transistor) reference voltage source having the source of supply voltage ($V_{DD}$) applied at terminal 11 and having a reference level shown at 13 which may be ground. Between terminal 11 and terminal 13, there is provided a voltage divider circuit comprising depletion FET $Q_1$ and enhancement FET $Q_2$. Between the voltage supply terminal 11 and the drain 34 of enhancement FET $Q_2$, there is provided a biasing circuit consisting of depletion FET $Q_3$ and enhancement FET $Q_4$. Finally, a connection 17 extends from the biasing circuit to the gate 19 of FET $Q_1$ so that both gates 19 and 15 of FETs $Q_1$ and $Q_2$ are subject to control by the biasing circuit consisting of FETs $Q_3$ and $Q_4$.

More specifically, lead 21 from supply terminal 11 extends to the drain 23 of FET $Q_3$. Its source 25 is connected to node 26, in turn connected to the drain 27 of FET $Q_4$ which has its source 29 connected by a lead 31 to the node 33 comprising the output lead for output voltage $V_0$.

The gate 35 for FET $Q_3$ is connected over lead 37 to node 39, (biasing voltage $V_1$) and then via lead 41 to node 43, in turn connected to the gate 45 of FET $Q_4$, and also via lead 47 to gate 15 of FET $Q_2$. Finally, nodes 39 and 26 are connected by lead 51. Lead 17 applies the biasing voltage $V_1$ to gate 19 of FET $Q_1$. $Q_1$ is the pull-up transistor with $Q_2$ being the pull-down transistor and both $Q_3$ and $Q_4$ are biasing transistors.

If, for any reason, $V_{DD}$ (the supply voltage) should rise, so long as node 26 stays one threshold above the output voltage $V_0$, then $V_0$ will still remain constant.

When $V_{DD}$ rises, the reason that $V_1$ at node 39 doesn't rise detectably, is because FET $Q_3$ has a large resistance compared to FET $Q_4$ and the voltage divider action of this biasing circuit is such as to maintain the gate voltage applied to gate 19 of $Q_1$ substantially constant during such gyrations. Of course, the larger the resistive ratios of $Q_3$ to $Q_4$, the better the constancy of the voltage at node $V_1$ will be. However, in actual practice a factor of some 10 to 1 is sufficient to manufacture a very effective operative device circuit.

Next, it will be shown how the subject circuit is very substantially temperature and supply voltage insensitive, and also the parameters and device and/or device geometries significant to the operation of the circuitry and determination of the output voltage will be discussed.

First, it is possible to derive an equation for the output voltage as follows:

$$V_0 = \sqrt{\frac{K_1}{K_2}}\,(V_{TE} - V_{TD})$$

wherein: the term $$\sqrt{\frac{K_1}{K_2}}$$

is determined by device geometries, while the term ($V_{TE}-V_{TD}$) is the difference of enhancement and depletion threshold voltages and can be precisely controlled with the proper implant dose. However, from this expression it can be seen that the circuit performance is independent of $V_{DD}$ (supply voltage). Furthermore, since $K_1$ and $K_2$, and $V_{TE}$ and $V_{TD}$ have very similar and tracking temperature characteristics, the circuit variations with respect to temperature will be minimal. Furthermore, the tracking characteristics of these two terms provides a reference voltage that is very tolerant to process variations, such as oxide thickness, substrate resistivity and other factors encountered in conventional manufacturing techniques.

For a derivation of the output voltage formula, reference may be had to FIG. 1 wherein the load current during depletion mode device $Q_1$ is given by:

$$I_1 = K_1(V_1 - V_0 - V_{TD})^2, \text{ for } V_0 \leqq V_{DD} - |V_{TD}| \quad (1)$$

wherein:

$$K_1 - \mu_D C_{ox}\left(\frac{W}{L}\right)_{Q1}$$

wherein:

$\mu_D$=surface mobility along depletion FET channel $C_{ox}$=oxide capacitance per unit gate area W=width of FET channel L=length of FET channel which is the formula for the constant ($K_1$) for depletion FET $Q_1$ which is the pull-up FET. The $V_{TD}$ is the threshold voltage of the depletion mode FET $Q_1$. The current $I_1$ is shown in FIG. 1 as being one of the input currents to node 33 shown as the output connection for output voltage $V_0$.

Now, if the depletion FET $Q_3$ is small, i.e. has a large channel resistance such that the drain current $I_{Bias}$ is very small, that is $I_{Bias}$ is much less than $I_1$, then for $Q_4$. $V_1$ is approximately $V_0+V_{TE}$ where $V_{TE}$ is the enhancement (2) FET threshold voltage for $Q_4$.

By substitution then the equation for $I_I$ becomes:

$$I_I=K_1(V_{TE}-V_{TD})^2 \quad (3)$$

The driver current through enhancement FET $Q_2$ operating in the saturation region is:

$$I_2=K_2(V_1-V_{TE})^2 \quad (4)$$

$I_2$ is shown as the current leaving node 33 and passing toward FET $Q_2$.

In the foregoing equation, $$K_2 = \mu_E C_{ox}\left(\frac{W}{L}\right)_{Q2}.$$

Here the definitions for $K_2$ are the same as the definitions for $K_1$ with the exception that they apply to FET $Q_2$, which is of an enhancement type.

In the foregoing, $V_1-V_{TE}=V_0$ according to the above equation (2) therefore:

$$I_2=K_2V_0^2$$

Again, if $I_{Bias}$ is much less than $I_1$, then $I_1$ is approximately equal to $I_2$ therefore from the previous equations:

$$K_1(V_{TE}-V_{TD})^2 = K_2 V_0^2$$

$$\text{or } V_0 = \sqrt{\frac{K_1}{K_2}}\,(V_{TE}-V_{TD})$$

In the above equation, for example if $V_{TE}$ equals 1.0 volt, and $V_{TD}$ equals −2 volts, then a 3 volt reference for $V_0$ can be generated by choosing $K_1=K_2$ (i.e. $Q_1$ and $Q_2$ with the same device sizes). Simarily a 1.5 volt reference ($V_0$) can be generated with $K_2=4K_1$ (i.e. $Q_2$ that is 4 times wider than $Q_1$).

In summary, with $Q_3$ large relative to $Q_4$, and $Q_2$ equal to $Q_4$, so that the threshold voltages for these devices are well matched, $Q_1$ and $Q_2$ must maintain the relationship of the $V_0$ equation due to their geometry.

Further reviewing the equation for $V_0$, it may be seen that all terms react to temperature in the same way, i.e. both $V_{TE}$ and $V_{TD}$ move up the same for elevated temperatures so cancel out, and it is pointed out that since $V_{DD}$ does not appear in the equation for output voltage, the circuit is insensitive to the supply voltage. Hence, the reference voltage is determined only by the device geometries and the difference of enhancement and depletion device threshold voltages.

It will now be seen that this circuit may find broad applications in products such as microprocessors and memories. The circuit may also be used in analog circuits and telecommunication products and it has the large advantage over the prior art of utilizing much less "real estate" on the chip to provide a constant reference source than any other prior art known, and thus it is more applicable to VLSI processing.

Recent n-channel processing now provides resistors because of the double polysilicon layer structures and the second layer poly may be manufactured into high value resistors. For this reason, and because the parameters and/or geometries of depletion FET $Q_3$ do not enter into the relationship expressed in the $V_0$ equation, it is possible to substitute a pure resistor for the FET $Q_3$.

Figure 2:
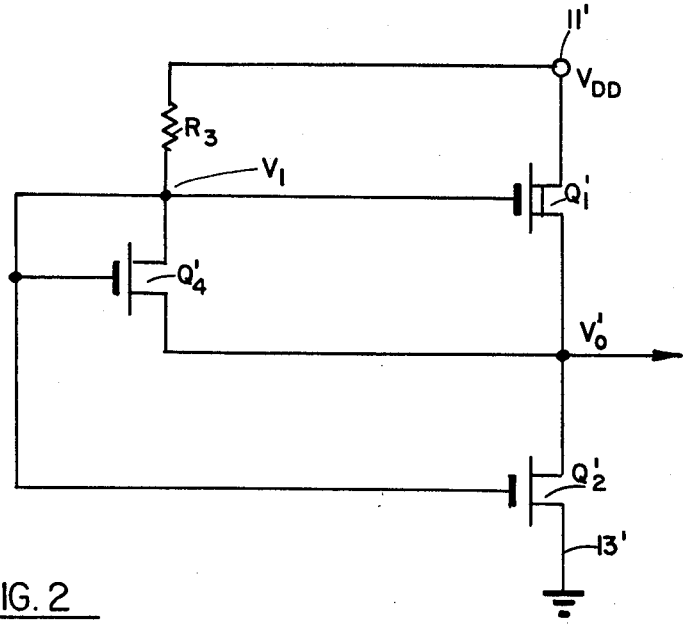
FIG. 2 shows a circuit comprising an alternative embodiment.

Accordingly, FIG. 2 shows a circuit identical to the circuit of FIG. 1 with the exception that resistor $R_3$ now replaces FET $Q_3$ and the operation and other components remain the same as previously described. $R_3$ is a biasing resistor merely replacing the biasing FET $Q_3$.

While the embodiments herein disclosed may admit of modification, nevertheless the principles of the invention are set forth in the claims and it is the scope of such claims which are intended to outline the boundaries of this invention.

What is claimed is:

1. A voltage and temperature insensitive reference circuit voltage source for predetermining the proportion of supply voltage to constitute the output voltage comprising in combination:

a pull-up depletion FET and a pull-down enhancement FET connected between a source of supply voltage and a reference point;

a two element biasing circuit connected between said source and the pull-down FET connected to the reference point;

said pull-up FET having a gate;

a connection from the biasing circuit at a point between said elements to said gate;

an output connection from the junction of said pull-up and pull-down FETs; and, one of said elements which is connected between the source and the other of said elements being characterized by high resistance relative to the other of said elements whereby the proportion of voltage available at said output connection remains substantially constant regardless of source voltage variation and ambient temperature, said other element comprising an enhancement FET matched to said pull-down FET; and, the ratio of the geometries of configuration of the pull-up FET to the pull-down FET determines said output voltage.

2. The circuit of claim 1, wherein the output voltage is predeterminable from the equation $$V_0 = \sqrt{\frac{K_1}{K_2}}\,(V_{TE}-V_{TD})$$

wherein:

$$K_1 = \mu_D C_{ox} \left( \frac{W}{L} \right)_{Q1}$$

of said pull-up FET, and $\mu_D$ is the surface mobility of said pull-up FET, $C_{ox}$ is the gate capacitance per unit area for said pull-up FET, which is also equal to $$\frac{\epsilon_{ox}}{t_{ox}}$$

wherein:

$\epsilon_o$ is the dielectric permittivity of the gate dielectric, and $t_{ox}$ is the gate dielectric thickness, W is channel width for said pull-up FET L is the channel length, $K_2$ corresponds to $K_1$ except the parameters are derived from said pull-down FET, $V_{TE}$ is the threshold voltage for the enhancement FET of the biasing circuit, and;

$V_{TD}$ is the threshold voltage for the pull-down FET depletion device whereby the output voltage level is selectible by changing the ratio of $K_1$ to $K_2$.

* * * * *